US010614931B2

(12) United States Patent
Watanabe et al.

(10) Patent No.: US 10,614,931 B2
(45) Date of Patent: Apr. 7, 2020

(54) COAXIAL CABLE AND MEDICAL CABLE

(71) Applicant: HITACHI METALS, LTD., Tokyo (JP)

(72) Inventors: Takanobu Watanabe, Hitachi (JP); Detian Huang, Hitachi (JP); Kimika Kudo, Kitaibaraki (JP); Haruyuki Watanabe, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/546,189

(22) PCT Filed: Jan. 27, 2015

(86) PCT No.: PCT/JP2015/052196
§ 371 (c)(1),
(2) Date: Jul. 25, 2017

(87) PCT Pub. No.: WO2016/121000
PCT Pub. Date: Aug. 4, 2016

(65) Prior Publication Data

US 2018/0342336 A1 Nov. 29, 2018

(51) Int. Cl.

| | |
|---|---|
| ***H01B 11/18*** | (2006.01) |
| ***H01B 3/30*** | (2006.01) |
| ***H01B 7/02*** | (2006.01) |

(52) U.S. Cl.
CPC ..... *H01B 11/1834* (2013.01); *H01B 3/30* (2013.01); *H01B 11/1808* (2013.01); *H01B 11/1847* (2013.01); *H01B 7/0208* (2013.01); *H01B 11/1856* (2013.01)

(58) Field of Classification Search
CPC . H01B 11/1834; H01B 11/18; H01B 11/1808; H01B 13/067; H01B 7/0208
See application file for complete search history.

(56) References Cited

U.S. PATENT DOCUMENTS

2013/0341065 A1* 12/2013 Sato ..... H01B 11/1895 174/107

FOREIGN PATENT DOCUMENTS

| | | | |
|---|---|---|---|
| JP | H4-25128 U | | 2/1992 |
| JP | H0474812 U | * | 6/1992 |
| JP | 06-036624 A | | 2/1994 |
| JP | H10-125145 A | | 5/1998 |

(Continued)

OTHER PUBLICATIONS

International Search Report and Written Opinion issued in the corresponding application PCT/JP2015/052196 dated Apr. 7, 2015.

(Continued)

*Primary Examiner* — Timothy J Thompson
*Assistant Examiner* — Amol H Patel
(74) *Attorney, Agent, or Firm* — Roberts Calderon; Safran & Cole P.C.

(57) ABSTRACT

A coaxial cable includes a central conductor, a plurality of insulating twisted threads or insulation strings wound therearound, each insulating twisted thread including a plurality of insulating strings twisted together, a cover layer provided around the insulating twisted threads or the insulation strings to form a gap to the insulating twisted threads or the insulation strings, and an outer conductor and a jacket provided on the outer periphery of the cover layer.

20 Claims, 4 Drawing Sheets

(56) References Cited

FOREIGN PATENT DOCUMENTS

| | | | | |
|---|---|---|---|---|
| JP | 2000-090753 | A | | 3/2000 |
| JP | 2000090753 | A | * | 3/2000 |
| JP | 2001-508588 | A | | 6/2001 |
| JP | 2004-063369 | A | | 2/2004 |
| JP | 2010-212185 | A | | 9/2010 |
| JP | 2011-060573 | A | | 3/2011 |
| JP | 2016058251 | A | | 4/2016 |
| WO | 98/31022 | | | 7/1998 |

OTHER PUBLICATIONS

Office Action issued in the corresponding Japanese Application No. 2016-571550 dated Jul. 25, 2017.
International Preliminary Report on Patentability issued in the corresponding application PCT/JP2015/052196.
Japanese Office Action issued in corresponding Japanese Application No. 2017-207729 dated Jun. 29, 2018.
Chinese Office Action issued in corresponding Chinese Application No. 201580074602.4 dated Aug. 16, 2018.
A Office Action issued in corresponding Chinese Application No. 201580074602.4 dated Jan. 17, 2019.
Office Action issued in corresponding Chinese Application No. 201580074602.4 dated Apr. 17, 2019.
A Office Action issued in corresponding Japanese Application No. 2018-187017 dated Jun. 27, 2019.

* cited by examiner

COAXIAL CABLE AND MEDICAL CABLE

CROSS-REFERENCE TO RELATED APPLICATIONS

The present application is a U.S. National Phase of PCT/JP2015/052196 filed on Jan. 27, 2015. The disclosure of the PCT Application is hereby incorporated by reference into the present Application.

TECHNICAL FIELD

The present invention relates to a coaxial cable and a medical cable.

BACKGROUND ART

There are various medical cables such as probe cable, catheter cable and endoscope cable, etc., which use a coaxial cable as a signal line. Coaxial cables provided with a foam insulation layer formed around a central conductor by foam extrusion coating are conventionally known as coaxial cables to be used inside such medical cables (see, e.g., PTLs 1 and 2). It is possible to reduce capacitance of the insulation layer by air bubbles formed by foaming.

As the size of medical devices is reduced, medical cables are required to have a smaller diameter and diameters of coaxial cables accordingly tend to be reduced.

Meanwhile, PTL 3 discloses a coaxial cable which is not for medical use. This coaxial cable is formed by enclosing a wire-shaped inner conductor in an insulating member and further enclosing the insulating member in an outer conductor, and the insulating member is composed of insulating cords twisted around the inner conductor.

CITATION LIST

Patent Literature

[PTL 1]
JP-A-2004-63369
[PTL 2]
JP-A-2010-212185
[PTL 3]
JP-A-2000-90753

SUMMARY OF INVENTION

Technical Problem

If the diameter of coaxial cable is reduced too much, the conductor could not withstand pressure used to produce foams and may be broken.

Also, if the thickness of the foam insulation layer is reduced to closer to a diameter of air bubbles (about 25 to 30 μm) formed by foaming for the purpose of reducing the diameter of coaxial cable, continuity of a resin during extrusion may be broken at an air bubble formation section, resulting in that the foam insulation layer is not formed on the conductor in some regions.

Thus, it is an object of the invention to provide a coaxial cable that is provided with a novel insulation layer capable of exerting a similar function to the foam insulation layer although having no foam insulation layer, as well as a medical cable using the coaxial cable.

Solution to Problem

To achieve the above-mentioned object, the invention provides a coaxial cable and a medical cable defined below.

[1] A coaxial cable, comprising: a central conductor; a plurality of insulating twisted threads or insulation strings wound therearound, each insulating twisted thread comprising a plurality of insulating strings twisted together; a cover layer provided around the insulating twisted threads or the insulation strings to form a gap to the insulating twisted threads or the insulation strings; and an outer conductor and a jacket provided on the outer periphery of the cover layer.

[2] The coaxial cable defined by [1], wherein the plurality of insulating twisted threads or insulation strings are wound directly on the central conductor.

[3] The coaxial cable defined by [1] or [2], wherein the cover layer has a tubular shape.

[4] The coaxial cable defined by any one of [1] to [3], wherein the cover layer is formed by extruding a resin selected from fluorine resin, polyethylene (PE) and polypropylene (PP).

[5] The coaxial cable defined by any one of [1] to [3], wherein the cover layer is formed by winding a polyethylene terephthalate (PET) tape, a polyetherimide (PEI) tape or a polyimide (PI) tape that comprises a hot-melt adhesive layer.

[6] The coaxial cable defined by any one of [1] to [5], wherein the central conductor comprises a twisted wire formed by twisting three or seven strands.

[7] The coaxial cable defined by any one of [1] to [6], wherein the central conductor has a size of 42 to 50 AWG.

[8] The coaxial cable defined by any one of [1] to [7], wherein the insulating twisted thread is formed by twisting two or three of the insulating strings.

[9] The coaxial cable defined by any one of [1] to [8], wherein the string constituting the insulating twisted thread comprises a fluorine resin filament.

[10] The coaxial cable defined by any one of [1] to [9], wherein the cross-sectional shape of the insulation string is a non-true circle.

[11] The coaxial cable defined by [10], wherein the non-true circle is a polygon or an ellipse.

[12] The coaxial cable defined by any one of [1] to [11], wherein three to eight of the insulating twisted threads or the insulation strings are wound around the central conductor.

[13] The coaxial cable defined by any one of [1] to [12], wherein the central conductor comprises a twisted wire, and the insulating twisted threads are wound around the central conductor in the opposite direction to the twisting direction of the central conductor.

[14] The coaxial cable defined by any one of [1] to [12], wherein the central conductor comprises a twisted wire, and the insulation strings are wound around the central conductor in the opposite direction to the twisting direction of the central conductor.

[15] The coaxial cable defined by any one of [1] to [3] and [5], wherein the cover layer is formed by winding a tape, and the tape is wound in the opposite direction to the winding direction of the insulating twisted threads or the insulation strings.

[16] A medical cable, comprising: a cable core that comprises one or more of the coaxial cables defined by any one of [1] to [15].

Advantageous Effects of Invention

According to the invention, a coaxial cable can be provided that is provided with a novel insulation layer capable of exerting a similar function to the foam insulation layer although having no foam insulation layer, as well as a medical cable using the coaxial cable.

DESCRIPTION OF EMBODIMENTS

[Coaxial Cable]

First Embodiment

Figure 1:
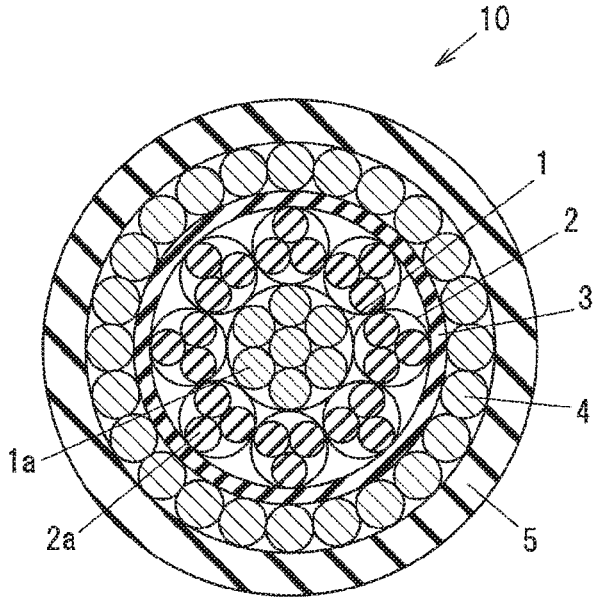
FIG. 1 is a lateral cross-sectional view showing a structure of a coaxial cable in the first embodiment of the present invention.

FIG. 1 is a lateral cross-sectional view showing a structure of a coaxial cable in the first embodiment of the invention A coaxial cable 10 in the first embodiment of the invention shown in FIG. 1 has a structure in which plural insulating twisted threads 2 each formed by twisting plural insulating strings 2*a* together are wound around the outer periphery of a central conductor 1.

The coaxial cable 10 has an insulating cover layer 3 on the plural insulating twisted threads 2 wound around the outer periphery of the central conductor 1. A layer of outer conductors 4 is provided around the cover layer 3 and is in turn covered with a jacket 5. The cover layer 3 is provided to form a gap to the insulating twisted threads 2.

The central conductor 1 may be a solid wire, but is preferably a twisted wire formed by twisting plural strands 1*a* to increase the percentage of gap formed between the central conductor 1 and the insulating twisted threads 2. The number of the strands 1*a* to be twisted together is not specifically limited, but is preferably three or seven to increase the percentage of gap formed between the central conductor 1 and the insulating twisted threads 2. In FIG. 1, seven strands 1*a* are twisted together.

The central conductor 1 is formed of, e.g., a copper alloy which may be plated with silver, etc. The central conductor 1 preferably has a small diameter, in detail, preferably has a size of 42 to 50 AWG (American Wire Gauge), more preferably 46 to 50 AWG, further preferably 48 to 50 AWG. The smaller the diameter, the more difficult it is to form a foam insulation cover layer by conventional extrusion. Therefore, the effect of the present invention is more significant for a smaller diameter.

The insulating twisted thread 2 is formed by twisting plural insulating strings 2*a* together. The first embodiment is more preferable than when using single insulation strings (the second embodiment, described later) since the percentage of gaps formed between the insulating twisted threads 2 and the central conductor 1/the cover layer 3 is further increased. The number of the insulating strings 2*a* to be twisted together is not specifically limited, but is preferably two or three to increase the percentage of gaps formed between the insulating twisted threads 2 and the central conductor 1/the cover layer 3. In FIG. 1, three insulating strings 2*a* are twisted together. The diameter of the insulating twisted thread 2 is preferably 30 to 100 μm.

The insulating string 2*a* constituting the insulating twisted thread 2 is, e.g., a filament formed of a fluorine resin. The preferable fluorine resin is, e.g., tetrafluoroethylene perfluoroalkyl vinyl ether copolymer (PFA) (e.g., trade name: FFY, manufactured by GUNZE Limited). Both monofilament and multifilament can be used, but monofilament is preferable to maintain the shape of the twisted thread 2 and to retain the gap between the layers. The lateral cross-sectional shape of the insulating string 2*a* is not specifically limited and can be various shaped.

The plural insulating twisted threads 2 are preferably wound directly on the central conductor 1 as shown in FIG. 1 to increase the percentage of gap directly above the central conductor 1. It is preferable that three to eight insulating twisted threads 2 be wound around the central conductor 1 to increase the percentage of gaps formed between the insulating twisted threads 2 and the central conductor 1/the cover layer 3. In FIG. 1, eight insulating twisted threads 2 are wound.

After winding the insulating twisted threads 2, other insulating twisted threads 2 may be further wound therearound in the opposite direction.

When the central conductor 1 is a twisted wire, the insulating twisted threads 2 are preferably wound around the central conductor 1 in the opposite direction to the twisting direction of the strands 1*a* of the central conductor 1. In other words, it is preferable to twist or wind alternately in the opposite directions and not continuously in the same direction. Meanwhile, the twisting direction of the insulating strings 2*a* may be any direction, but is preferably opposite to the twisting direction of the strands 1*a* of the central conductor 1 to increase the gap percentage.

The cover layer 3 has a tubular shape and is formed by, e.g., extruding a resin selected from fluorine resin, polyethylene (PE) and polypropylene (PP). The preferable fluorine resin is, e.g., tetrafluoroethylene-ethylene copolymer (ETFE), tetrafluoroethylene-hexafluoropropylene copolymer (FEP) and tetrafluoroethylene perfluoroalkyl vinyl ether copolymer (PFA). The thickness of the cover layer 3 formed by extrusion coating is preferably 8 to 30 μm.

The cover layer 3 may be formed by winding a polyethylene terephthalate (PET) tape, a polyetherimide (PEI) tape or a polyimide (PI) tape, which is provided with a hot-melt adhesive layer. The hot-melt adhesive layer is a layer formed of a hot-melt adhesive which can be bonded through the application of pressure and heat. The tape is preferably wound with an overlap, and is preferably wound in the opposite direction to the twisting direction of the insulating twisted threads 2 located immediately below. The thickness of the hot-melt adhesive layer is, e.g., 0.5 to 2 μm, and the thickness of the tape formed of each base material is, e.g., 2 to 6 μm.

The material of the cover layer 3 is preferably a hard material to prevent the cover layer 3 from sinking inward and filling the gap between the cover layer 3 and the insulating twisted threads 2.

The percentage of the gap present on the central conductor 1 side of the cover layer 3 (mainly gaps between the insulating twisted threads 2 and the central conductor 1/the cover layer 3) is preferably 30 to 60%, more preferably 40 to 55%, of the cable cross-sectional area. The gap percentage can be measured by the following method.

<Gap Percentage Measurement Method>

A half-finished product of a cable composed of a central conductor, insulating twisted threads and a cover layer is arranged and fixed in, e.g., a thermosetting resin such as epoxy resin, and subsequently, the cross-sectional surface thereof is polished by polishing powder, etc. Using the image of the polished cross-sectional surface, the areas of the central conductor, the insulating twisted threads and the cover layer are measured. A difference between the total of these areas and an area of a circle with a diameter equal to the outer diameter of the cover layer (the outer diameter of the half-finished product of the cable) is an area of the gaps. The gap percentage is obtained by calculating a percentage of the gap area in the area of the circle with a diameter equal to the outer diameter of the cover layer.

The outer conductor 4 is, e.g., a tin-plated copper wire, a tin-plated copper alloy wire, a silver-plated copper wire or a silver-plated copper alloy wire. Plural (e.g., thirty to sixty) outer conductors 4 are spirally wound around the cover layer 3 at a predetermined pitch. When the cover layer 3 is formed by winding a tape, the outer conductors 4 are wound in the opposite direction to the winding direction of the cover layer 3.

The jacket 5 can be provided by winding a PET tape, or by extruding ETFE, FEP or PFA, etc.

Second Embodiment

Figure 2:
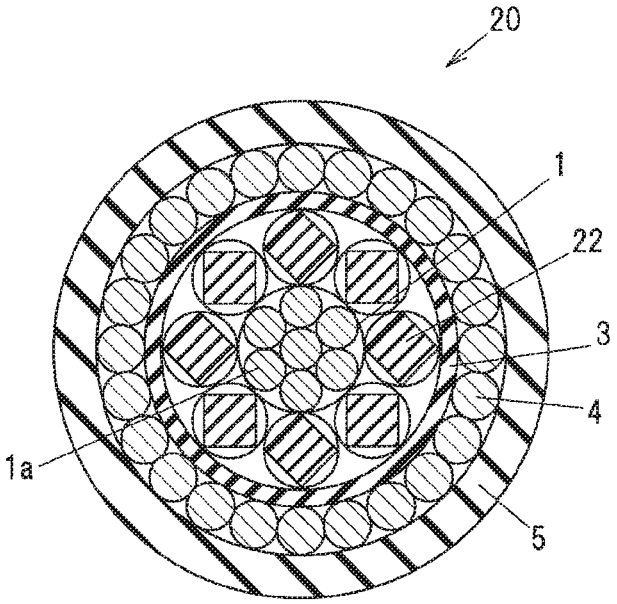
FIG. 2 is a lateral cross-sectional view showing a structure of a coaxial cable in the second embodiment of the invention.

FIG. 2 is a lateral cross-sectional view showing a structure of a coaxial cable in the second embodiment of the invention.

A coaxial cable 20 in the second embodiment of the invention shown in FIG. 2 has a structure in which plural insulation strings 22 are wound around the central conductor 1. The coaxial cable 20 in the second embodiment differs from the coaxial cable 10 in the first embodiment only in that the insulation strings 22 are wound around the central conductor 1 instead of winding the insulating twisted threads 2. Thus, the explanation of the same features will be omitted.

The insulation string 22 has a non-true circular cross-sectional shape. The cross-sectional shape of the insulation string 22 used in FIG. 2 is a square, but may be a polygon other than square, or may be an ellipse as is an insulation string 32 of a coaxial cable 30 in a modification of the second embodiment shown in FIG. 3. The elliptical shape is preferably an ellipse with the minor axis not less than 20% shorter than the major axis, more preferably an ellipse with the minor axis not less than 30% shorter than the major axis.

Figure 4A:
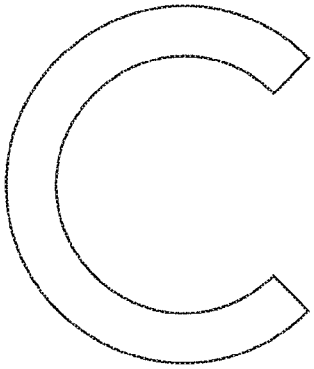
FIG. 4A is a lateral cross-sectional view showing a modification of the shape of an insulation string in the second embodiment of the invention.
Figure 4B:
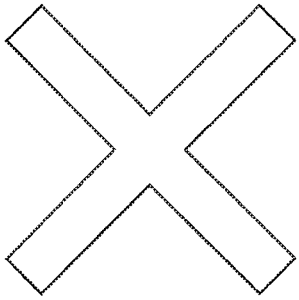
FIG. 4B is a lateral cross-sectional view showing another modification of the shape of the insulation string in the second embodiment of the invention.
Figure 4C:
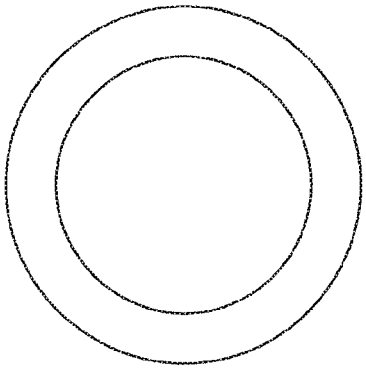
FIG. 4C is a lateral cross-sectional view showing another modification of the shape of the insulation string in the second embodiment of the invention.
Figure 4D:
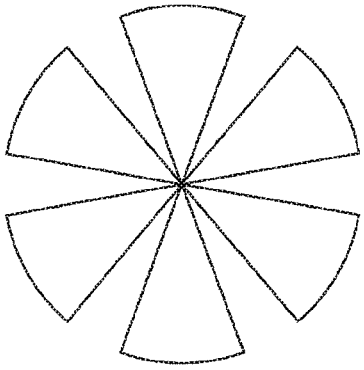
FIG. 4D is a lateral cross-sectional view showing another modification of the shape of the insulation string in the second embodiment of the invention.

Alternatively, the cross-sectional shape of the insulation strings 22 and 32 may be a concave polygon or an ellipse with a dent(s). Furthermore, as shown in FIGS. 4A to 4D, the cross-sectional shape of the insulation strings 22 and 32 may be a C-shape (FIG. 4A), a cross shape (FIG. 4B), a hollow tubular shape (FIG. 4C) or a shape with radial triangles (FIG. 4D). A shape with three to five vertices or an ellipse is preferable to increase the percentage of gaps formed between the insulation strings and the central conductor 1/the cover layer 3. Although the insulation string 22 will be described below as an example, the same applies to the insulation string 32 and other modifications.

The insulation string 22 is preferably configured that the thickness after being wound around the central conductor 1 is 30 to 100 μm.

The insulation string 22 is preferably formed of, e.g., a filament of a fluorine resin in the same manner as the insulating strings 2*a* constituting the insulating twisted thread 2. The fluorine resin and the filament are the same as described above.

The insulation strings 22 are preferably wound directly on the central conductor 1 as shown in FIG. 2 to increase the percentage of gap directly above the central conductor 1. It is preferable that three to eight insulation strings 22 be wound around the central conductor 1 to increase the percentage of gaps formed between the insulation strings 22 and the central conductor 1/the cover layer 3. In FIG. 2, eight insulation strings 22 are wound.

Also, the insulation strings 22 having a non-true circular cross-sectional shape are preferably wound while untwisting. It is thereby possible to increase the percentage of gaps formed between the insulation strings 22 and the central conductor 1/the cover layer 3.

After winding the insulation strings 22, other insulation strings 22 may be further wound therearound in the opposite direction. In this case, it is possible to provide a gap between a layer of the insulation strings 22 on the inner side (on the central conductor 1 side) and a layer of the insulation strings 22 on the outer side (on the cover layer 3 side).

When the central conductor 1 is a twisted wire, the insulation strings 22 are preferably wound around the central conductor 1 in the opposite direction to the twisting direction of the strands 1*a* of the central conductor 1. In other words, it is preferable to twist or wind alternately in the opposite directions and not continuously in the same direction.

When the cover layer 3 is formed by winding a tape, the tape is preferably wound in the opposite direction to the winding direction of the insulation strings 22 located immediately below.

Figure 5:
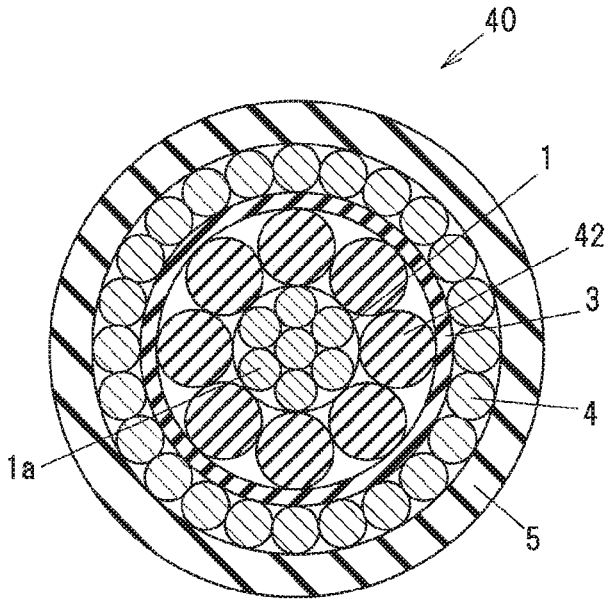
FIG. 5 is a lateral cross-sectional view showing a structure of a coaxial cable in another modification of the second embodiment of the invention.

FIG. 5 is a lateral cross-sectional view showing a structure of a coaxial cable in another modification of the second embodiment of the invention.

A coaxial cable 40 in a modification of the second embodiment of the invention shown in FIG. 5 differs from the coaxial cable 20 in the second embodiment only in that insulation strings 42 having a circular cross-sectional shape are used instead of the insulation strings 22 having a square cross-sectional shape.

The insulation string 22 having a non-true circular cross-sectional shape is more preferable than the insulation string 42 having a circular cross-sectional shape in view of increasing the percentage of gaps formed between the insulation strings and the central conductor 1/the cover layer 3.

The percentage of the gap present on the central conductor 1 side of the cover layer 3 (mainly gaps between the insulation strings 22 and the central conductor 1/the cover layer 3) is preferably 30 to 60%, more preferably 40 to 55%, of the cable cross-sectional area. The gap percentage can be measured by the method described above.

The coaxial cables in the embodiments of the invention are suitable to be used inside medical cables, but may be used in other cables.

[Medical Cable]

A medical cable in the embodiment of the invention has a cable core formed using one or more coaxial cables in the embodiments of the invention.

Figure 6:
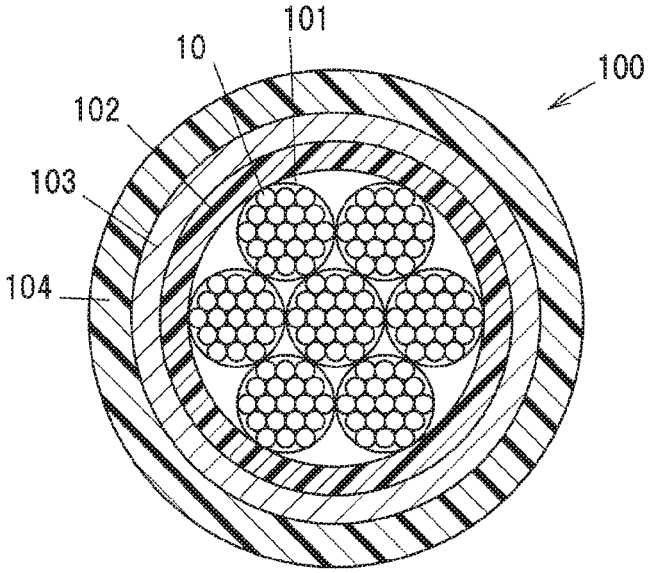
FIG. 6 is a lateral cross-sectional view showing a structure of a medical cable in an embodiment of the invention.

FIG. 6 is a lateral cross-sectional view showing a structure of a probe cable which is one of medical cables in the embodiment of the invention.

Plural coaxial cables in the embodiment of the invention (e.g., the coaxial cables 10 in the first embodiment) are bundled (and may be twisted after bundling) to be formed into a coaxial cable unit 101, plural coaxial cable units 101 (seven in FIG. 6) are bundled with a binding tape 102 of PTFE (polytetrafluoroethylene), etc., to be formed into a cable core, a shield layer 103 is provided therearound by winding or braiding plural metal wires such as silver-plated copper wires, and a sheath 104 formed of PFA or PVC (polyvinyl chloride) is provided around the shield layer 103, thereby obtaining a probe cable 100. The coaxial cable unit 101 preferably has a cover layer around the bundled plural coaxial cables.

Medical cable other than probe cable i.e. catheter cable and endoscope cable etc. also basically has the same structure as the probe cable, except that the number of the coaxial cables is different. In this regard, the catheter cable may be formed using only one coaxial cable. A power line or another signal line may be additionally included.

Effects of the Embodiments of the Invention

The following effects are obtained in the embodiment of the invention.

(1) Since a gap to the central conductor or to the cover layer can be provided, it is possible to provide a coaxial cable which does not have a foam insulation layer but is provided with a novel insulation layer capable of exerting a similar function to that of the foam insulation layer, and also possible to provide a medical cable using such coaxial cable(s).

(2) It is possible to provide a coaxial cable with a gap provided uniformly in the longitudinal and circumferential directions of the cable, and also possible to provide a medical cable using such coaxial cable(s).

EXAMPLES

Next, the coaxial cables in the embodiments of the invention will be described in more detail in reference to Examples. However, the invention is not limited to these Examples.

Figure 3:
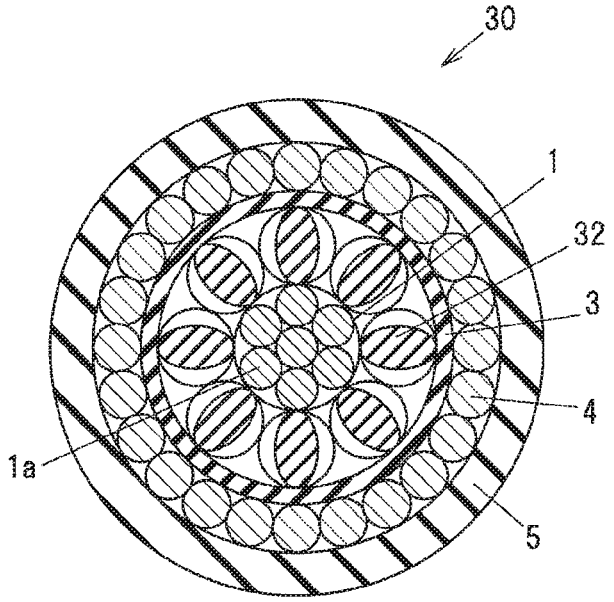
FIG. 3 is a lateral cross-sectional view showing a structure of a coaxial cable in a modification of the second embodiment of the invention.

Coaxial cables having the structures shown in FIGS. 3 and 5 were made by the following method, and capacitance thereof was measured.

Example 1

A coaxial cable was made using the materials shown in Table 1. That is, an inner conductor was formed by twisting seven 0.013 mm-diameter silver-plated copper alloy strands, six PFA monofilaments (40 μm in diameter) having a circular cross section as insulation strings were wound around the inner conductor at a winding pitch of 1.2 mm, a 0.005 mm-thick PET tape with a hot-melt adhesive layer was wound as a cover layer around the insulation strings, twenty-six 0.017 mm-diameter silver-plated copper alloy strands as outer conductors were spirally wound around the cover layer, and a PET tape with a hot-melt adhesive layer and a PET tape were sequentially wound around the outer conductors, thereby obtaining a coaxial cable having an outer diameter of 0.193 mm.

Examples 2 and 3

In Example 2, a coaxial cable having an outer diameter of 0.213 mm was made in the same manner as Example 1, except that five round monofilaments with a diameter of 55 μm were used as insulation strings and the number of the outer conductors was changed accordingly. Meanwhile, in Example 3, a coaxial cable having an outer diameter of 0.223 mm was made in the same manner as Example 1, except that five ellipse monofilaments with a major axis of 50 μm and a minor axis of 40 μm on the cross section were used as insulation strings and the number of the outer conductors was changed accordingly.

The measurement results of capacitance of the coaxial cables in Examples 1 to 3 are shown in Table 1. As understood from Table 1, the coaxial cables in the embodiments of the invention can achieve a capacitance of 60 to 72 pF/m, which is equivalent to that of the foam extrusion.

TABLE 1

| | | Example 1 | Example 2 | Example 3 |
|---|---|---|---|---|
| Central conductor | Material | Silver-plated copper alloy | Silver-plated copper alloy | Silver-plated copper alloy |
| | Number of strands | 7 | 7 | 7 |
| | Strand diameter (mm) | 0.013 | 0.013 | 0.013 |
| Insulation string | Shape | Round monofilament | Round monofilament | Ellipse monofilament |
| | Material | PFA | PFA | PFA |
| | Number of strings | 6 | 5 | 5 |
| | Diameter (μm) | 40 | 55 | Major axis: 50<br>Minor axis: 40 |
| | Winding pitch (mm) | 1.2 | 1.2 | 1.2 |
| Cover layer | Material | PET Tape with Hot-melt adhesive layer | PET Tape with Hot-melt adhesive layer | PET Tape with Hot-melt adhesive layer |
| | Thickness (mm) | 0.005 | 0.005 | 0.005 |
| Outer conductor | Material | Silver-plated copper alloy | Silver-plated copper alloy | Silver-plated copper alloy |
| | Number of strands | 26 | 31 | 29 |
| | Strand diameter (mm) | 0.017 | 0.017 | 0.017 |
| Jacket | Material | PET Tape with Hot-melt adhesive layer/PET tape | PET Tape with Hot-melt adhesive layer/PET tape | PET Tape with Hot-melt adhesive layer/PET tape |
| | Thickness (mm) | 0.015 | 0.015 | 0.015 |
| Outer diameter of Coaxial cable (mm) | | 0.193 | 0.213 | 0.223 |
| Cross-sectional shape of Coaxial cable | | FIG. 5 | FIG. 5 | FIG. 3 |
| Capacitance (pF/m) | | 72 | 62 | 60 |

The invention is not to be limited to the embodiments and Examples, and various modifications can be implemented.

REFERENCE SIGNS LIST

1 CENTRAL CONDUCTOR
1*a* STRAND
2 INSULATING TWISTED THREAD
2*a* INSULATING STRING
3 COVER LAYER
4 OUTER CONDUCTOR
5 JACKET
10, 20, 30, 40 COAXIAL CABLE
22, 32, 42 INSULATION STRING
100 PROBE CABLE
101 COAXIAL CABLE UNIT
102 BINDING TAPE
103 SHIELD LAYER
104 SHEATH

The invention claimed is:

1. A coaxial cable, comprising:
a central conductor;
a plurality of insulating twisted threads or insulation strings wound therearound, each insulating twisted thread comprising a plurality of insulating strings twisted together;
a cover layer provided around the insulating twisted threads or the insulation strings to form a gap to the insulating twisted threads or the insulation strings; and
an outer conductor and a jacket provided on the outer periphery of the cover layer,
wherein the plurality of insulating twisted threads or insulation strings are wound directly on the central conductor, and
wherein the central conductor comprises a twisted wire, and the insulation strings are wound around the central conductor in the opposite direction to the twisting direction of the central conductor.

2. The coaxial cable according to claim 1, wherein the cover layer has a tubular shape.

3. The coaxial cable according to claim 1, wherein the cover layer is formed by extruding a resin selected from fluorine resin, polyethylene (PE) and polypropylene (PP).

4. The coaxial cable according to claim 1, wherein the cover layer is formed by winding a polyethylene terephthalate (PET) tape, a polyetherimide (PEI) tape or a polyimide (PI) tape that comprises a hot-melt adhesive layer.

5. The coaxial cable according to claim 1, wherein the central conductor comprises a twisted wire formed by twisting three or seven strands.

6. The coaxial cable according to claim 1, wherein the central conductor has a size of 42 to 50 AWG.

7. The coaxial cable according to claim 1, wherein the string constituting the insulating twisted thread comprises a fluorine resin filament.

8. The coaxial cable according to claim 1, wherein the cross-sectional shape of the insulation string is a non-true circle.

9. The coaxial cable according to claim 8, wherein the non-true circle is a polygon or an ellipse.

10. The coaxial cable according to claim 1, wherein three to eight of the insulating twisted threads or the insulation strings are wound around the central conductor.

11. A medical cable, comprising a cable core that comprises one or more of the coaxial cables according to claim 1.

12. A coaxial cable, comprising:
a central conductor;
a plurality of insulating twisted threads or insulation strings wound therearound, each insulating twisted thread comprising a plurality of insulating strings twisted together;
a cover layer provided around the insulating twisted threads or the insulation strings to form a gap to the insulating twisted threads or the insulation strings; and
an outer conductor and a jacket provided on the outer periphery of the cover layer, directly on the central conductor, and
wherein the central conductor comprises a twisted wire, and the insulating twisted threads are wound around the central conductor in the opposite direction to the twisting direction of the central conductor.

13. The coaxial cable according to claim 12, wherein the insulating twisted thread is formed by twisting two or three of the insulating strings.

14. A coaxial cable, comprising:
a central conductor;
a plurality of insulating twisted threads or insulation strings wound therearound, each insulating twisted thread comprising a plurality of insulating strings twisted together;
a cover layer provided around the insulating twisted threads or the insulation strings to form a gap to the insulating twisted threads or the insulation strings; and
an outer conductor and a jacket provided on the outer periphery of the cover layer,
wherein the cover layer is formed by winding a tape, and the tape is wound in the opposite direction to the winding direction of the insulating twisted threads or the insulation strings.

15. The coaxial cable according to claim 14, wherein the cover layer has a tubular shape.

16. The coaxial cable according to claim 14, wherein the cover layer is formed by winding a polyethylene terephthalate (PET) tape, a polyetherimide (PEI) tape or a polyimide (PI) tape that comprises a hot-melt adhesive layer.

17. The coaxial cable according to claim 14, wherein the central conductor comprises a twisted wire, and the insulating twisted threads are wound around the central conductor in the opposite direction to the twisting direction of the central conductor.

18. The coaxial cable according to claim 14, wherein the central conductor comprises a twisted wire, and the insulation strings are wound around the central conductor in the opposite direction to the twisting direction of the central conductor.

19. A medical cable, comprising a cable core that comprises one or more of the coaxial cables according to claim 14.

20. A coaxial cable, comprising:
a central conductor;
a plurality of insulating twisted threads or insulation strings wound therearound, each insulating twisted thread comprising a plurality of insulating strings twisted together;
a cover layer provided around the insulating twisted threads or the insulation strings to form a gap to the insulating twisted threads or the insulation strings; and
an outer conductor and a jacket provided on the outer periphery of the cover layer, wherein the plurality of insulating twisted threads or insulation strings are wound directly on the central conductor,
wherein the central conductor comprises a twisted wire, and the insulation strings are wound around the central conductor in the opposite direction to the twisting direction of the central conductor, and wherein the cross-sectional shape of the insulation string is a non-true circle.

* * * * *